US008602227B1

(12) United States Patent
McDonald

(10) Patent No.: US 8,602,227 B1
(45) Date of Patent: Dec. 10, 2013

(54) SLATWALL PANEL

(75) Inventor: Robert Scott McDonald, Fruitport, MI (US)

(73) Assignee: Megawall, Inc., Comstock Park, MI (US)

( * ) Notice: Subject to any disclaimer, the term of this patent is extended or adjusted under 35 U.S.C. 154(b) by 182 days.

(21) Appl. No.: 13/155,771

(22) Filed: Jun. 8, 2011

(51) Int. Cl.
*A47F 5/08* (2006.01)

(52) U.S. Cl.
USPC ..... 211/94.01; 211/90.01; 211/193

(58) Field of Classification Search
USPC ..... 211/94.01, 59.1, 57.1, 90.01, 193, 211/87.01, 183; 248/224.41, 224.51, 248/224.61; 108/108, 29; 52/36.4; D25/123, 125
See application file for complete search history.

(56) References Cited

U.S. PATENT DOCUMENTS

| | | | | |
|---|---|---|---|---|
| 4,308,961 | A * | 1/1982 | Kunce | 211/94.01 |
| 4,752,010 | A | 6/1988 | Holztrager | |
| 4,817,538 | A * | 4/1989 | Michaelsen | 108/108 |
| 5,138,803 | A * | 8/1992 | Grossen | 52/36.4 |
| 5,655,674 | A | 8/1997 | Holztrager | |
| 5,921,044 | A | 7/1999 | Holztrager | |
| 6,491,172 | B2 * | 12/2002 | Chance et al. | 211/87.01 |
| 6,547,086 | B1 * | 4/2003 | Harvey | 211/87.01 |
| 6,631,813 | B1 * | 10/2003 | Walter et al. | 211/94.01 |
| 6,772,890 | B2 * | 8/2004 | Campbell et al. | 211/94.01 |
| 6,837,384 | B2 * | 1/2005 | Secondino | 211/87.01 |
| 7,122,744 | B2 * | 10/2006 | Walter et al. | 174/163 R |
| 7,591,385 | B2 * | 9/2009 | Brooks | 211/94.01 |
| 7,793,450 | B2 * | 9/2010 | Chasmer et al. | 40/657 |
| 8,066,130 | B2 * | 11/2011 | Shaha et al. | 211/90.01 |
| 8,128,043 | B2 * | 3/2012 | Walter | 248/224.7 |
| 8,146,754 | B2 * | 4/2012 | Apgood et al. | 211/94.01 |
| 2003/0189019 | A1 * | 10/2003 | Campbell et al. | 211/94.01 |
| 2004/0200791 | A1 * | 10/2004 | Bostick et al. | 211/94.01 |
| 2005/0247653 | A1 * | 11/2005 | Brooks | 211/94.01 |
| 2006/0091093 | A1 * | 5/2006 | Armari | 211/94.01 |
| 2006/0175274 | A1 * | 8/2006 | Yang | 211/94.01 |
| 2008/0061018 | A1 * | 3/2008 | Keller | 211/94.01 |

* cited by examiner

*Primary Examiner* — Jennifer E Novosad
(74) *Attorney, Agent, or Firm* — Shlesinger, Arkwright & Garvey LLP

(57) ABSTRACT

A slatwall panel comprises a backboard and a slatwall channel attached to the backboard. The slatwall channel includes a longitudinal horizontal slot, and opposing longitudinal first and second grooves parallel to the slot. First and second substrates include edge portions disposed in the first and second grooves, respectively. The slot includes a rear wall, a bottom wall and a top wall forming a U-shaped groove. The bottom wall is slanted downwardly toward the rear wall; and the U-shaped groove is configured to receive a shelf wherein the top wall provides a stop to a top rear portion of the shelf and a front portion of the bottom wall provides support to a bottom rear portion of the shelf.

14 Claims, 3 Drawing Sheets

SLATWALL PANEL

FIELD OF THE INVENTION

The present invention relates generally to a display wall assembly for use in displaying merchandise.

BACKGROUND OF THE INVENTION

Slatwall panels are generally manufactured by assembling a plurality of slatwall profiles generally made from extruded plastic material. These profiles are generally attached directly to an existing wall to make a slatwall panel. Examples of this type of slatwall panels are disclosed in U.S. Pat. Nos. 5,921,044; 4,752,010; and 5,655,674.

SUMMARY OF THE INVENTION

The present invention provides a slatwall panel, comprising a backboard and a slatwall channel attached to the backboard. The slatwall channel includes a longitudinal horizontal slot, and opposing longitudinal first and second grooves parallel to the slot. First and second substrates have edge portions disposed in the first and second grooves, respectively. The slot includes a rear wall, a bottom wall and a top wall forming a U-shaped groove. The bottom wall is slanted downwardly toward the rear wall; and the U-shaped groove is configured to receive a shelf wherein the top wall provides a stop to a top rear portion of the shelf and a front portion of the bottom wall provides support to a bottom rear portion of the shelf.

The present invention also provides a slatwall panel, comprising a backboard; and a slatwall channel attached to the backboard. The slatwall channel includes a longitudinal horizontal slot, and opposing longitudinal first and second grooves parallel to the slot. The first groove includes first rear wall and front wall. The second groove includes second rear wall and second front wall. First and second substrates with corresponding edge portions are disposed in the first and second grooves, respectively. Finish layer is disposed on exterior surfaces of the first and second substrates; and the finish layer overlaps the first and second front walls.

The present invention further provides a slatwall system, comprising first and second slat wall panels disposed side to side. The first slat wall panel includes a number of horizontal first slots. The second slat wall panel includes a number of horizontal second slots; and one of the first slots is not aligned with any one of the second slots.

The present invention also provides a slatwall channel for use in the assembly of a slatwall panel, comprising a body including a longitudinal horizontal slot, and opposing longitudinal first and second grooves parallel to the slot. The slot includes a rear wall, a bottom wall and a top wall forming a U-shaped groove. The bottom wall is slanted downwardly toward the rear wall; and the U-shaped groove is configured to receive a shelf wherein the top wall provides a stop to a top rear portion of the shelf and a front portion of the bottom wall provides support to a bottom rear portion of the shelf.

DETAILED DESCRIPTION OF THE INVENTION

Figure 1:
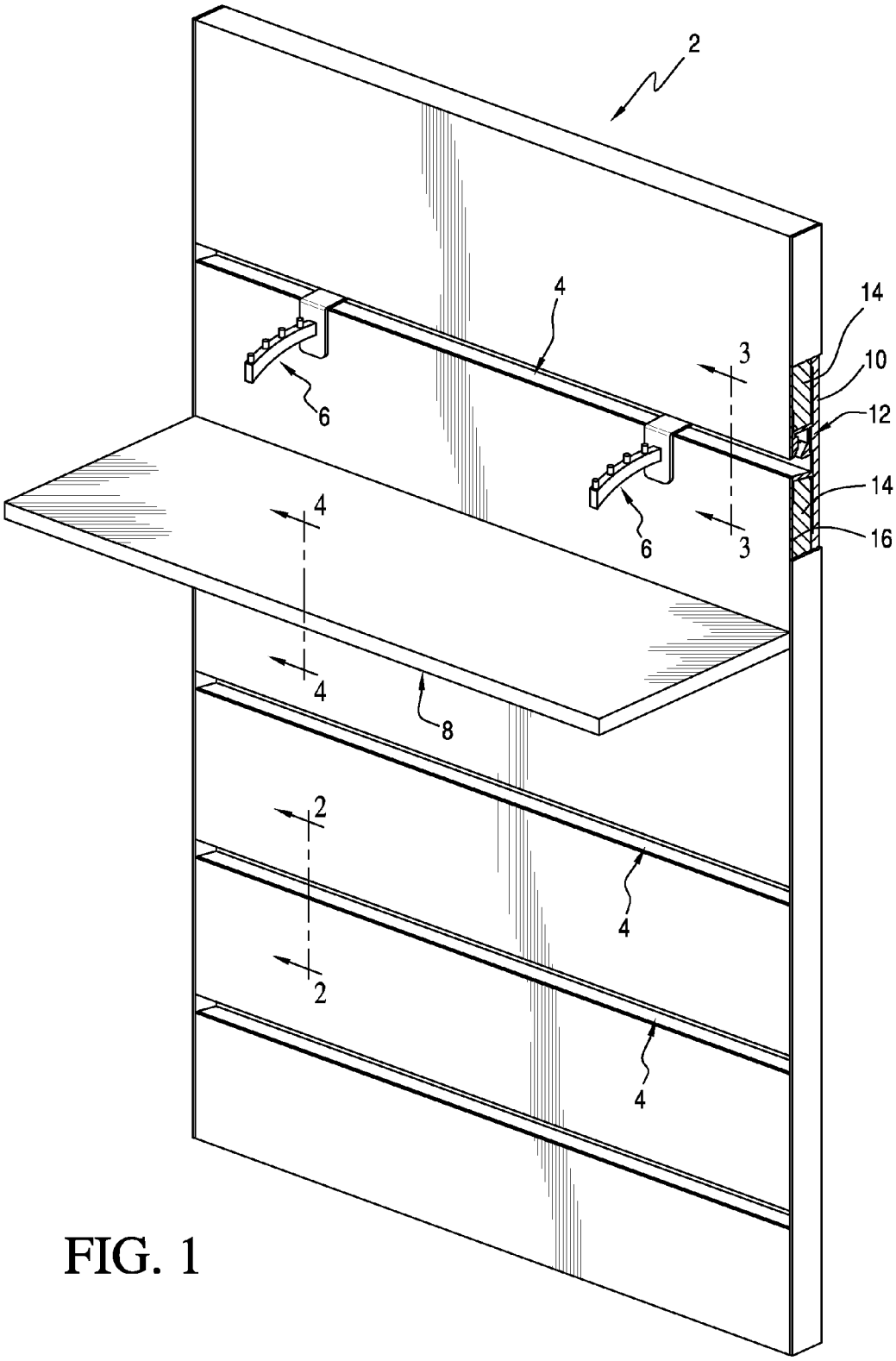
FIG. 1 is a perspective view of a slatwall panel embodying the present invention, with portions shown in cross-section.

A slatwall panel 2 embodying the present invention is disclosed in FIG. 1. The panel includes a plurality of longitudinal horizontal slots 4. Although shown with the slots 4 as being evenly spaced from one another, it should be understood that the slots 4 could be spaced at any desired distance, evenly or unevenly, from one another, depending on the application. It should also be understood that a slatwall 2 with one single slot 4 is also within the scope of the present invention. The slots 4 are used to hold standard hanging brackets 6 and a shelf 8. A number of the shelf 8 may be used, although only one shelf is shown. The shelf 8 is preferably made of light-transmitting glass, plastic, or other suitable materials, opaque or light transmitting, designed to support a load.

The slatwall panel 4 comprises a backboard 10 and a plurality of bodies made of extruded slatwall channels 12 that provide the slots 4. The backboard 10 may be part of an existing wall structure, or may be separate therefrom. Substrates 14 are attached to the slatwall channels 12 and the backboard 10. A finish layer 16 is attached to the respective outer front surfaces of the substrates 14. The slatwall channels 12 are preferably made of aluminum, but other suitable materials, such as plastic, may also be used.

Figure 2:
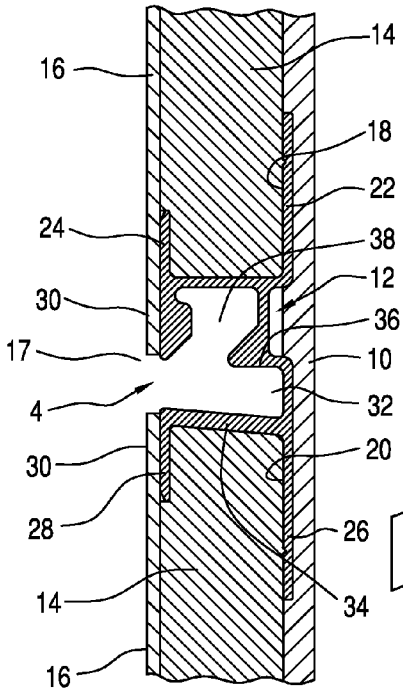
FIG. 2 is a cross-sectional view taken along line 2-2 in FIG. 1.

Referring to FIG. 2, a slatwall channel 12 is shown in detail. The slatwall channel 12 includes the slot 4 with an outside opening 17 and opposing longitudinal horizontal upper groove 18 and lower groove 20. Edge portions of the respective substrates 14 are received in the respective grooves 18 and 20. The upper groove 18 includes a back wall 22 and a front wall 24. Similarly, the lower groove 20 includes a back wall 26 and a front wall 28. The back walls 22 and 26 are attached to the backboard 10 by standard means, such as screws, nails, adhesives, etc. The substrates 14 are attached to the backboard 10 by standard means, such as screws, nails, adhesives, etc. The finish layer 16 is attached to the outer front surfaces of the respective substrates 14 by standard means, such as adhesives. Preferably, an edge portion 30 of the layer 16 overlaps the respective front walls 24 and 28 of the slatwall channel 12. The finish layer 16 may be made of wood veneer, bamboo veneer, laminate, plastic, paint or some other suitable finish coverings.

Referring back to FIG. 2, the slot 4 includes a rear wall 32, a bottom wall 34 and a top wall 36, forming a U-shaped groove. The bottom wall 34 is slanted downwardly to the rear wall 32 to facilitate insertion of the shelf 8 into the slot 4. The bottom wall 34 joins the back wall 26 and the front wall 28 of the lower groove 20. The rear wall 32 has an inside height dimension larger than the thickness of the shelf 8 to provide space 37 (see FIG. 4) to facilitate insertion of the shelf 8. Similarly, the height of the opening 17 of the slot 4 is higher than the thickness of the shelf 8, providing a gap or space 39 (see FIG. 4).

Figure 3:
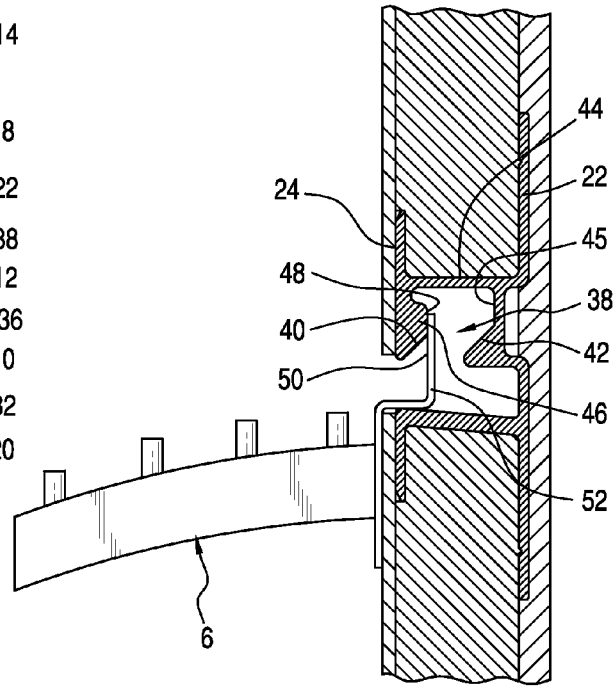
FIG. 3 is a cross-sectional view taken along line 3-3 in FIG. 1.
Figure 5:
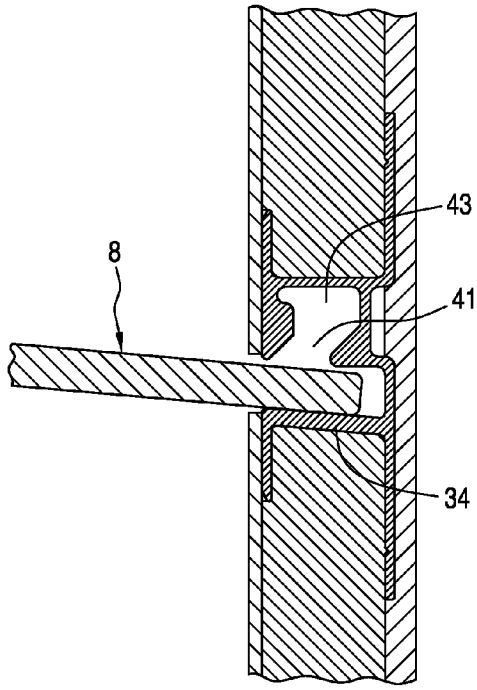
FIG. 5 is a cross-sectional view similar to FIG. 4, showing a shelf being inserted into a slot.

Referring to FIGS. 3 and 5, a branch groove 38 is disposed above the slot 4 and communicates therewith. The groove 38 has a slanted portion 41 and a vertical portion 43, providing a configuration to receive a hanging bracket 6. The slanted portion 41 includes opposed inclined surfaces 40 and 42. The vertical portion 43 includes opposed vertical surfaces 48 and 45. The front wall 24 and the back wall 22 are joined by a horizontal top wall 44. The front wall 24 includes a projection 46 disposed inside the branch groove 38. The projection 46 includes the inclined surface 40 and the vertical surface 48 for engaging an end portion 50 of a Z-shaped member 52 of the bracket 6.

Figure 4:
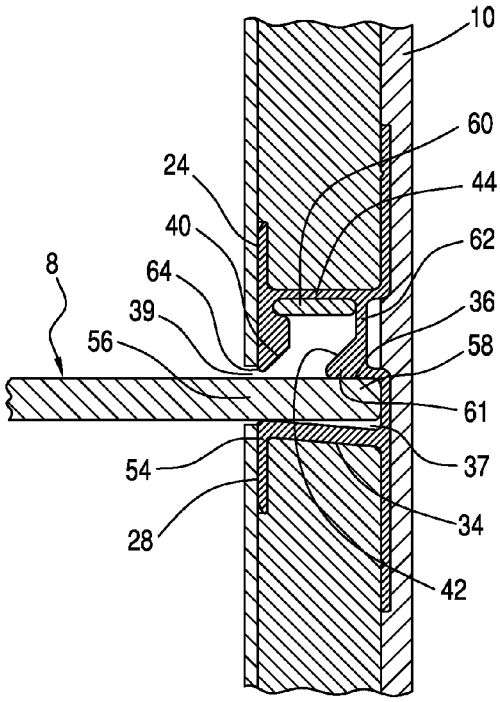
FIG. 4 is a cross-sectional view taken along line 4-4 in FIG. 1.

Referring to FIGS. 4 and 5, a front corner portion 54 of the bottom wall 34 and the front wall 28 provides support to a bottom rear portion 56 of the shelf 8. The top wall 36 provides support to a top rear portion 58 of the shelf 8. The shelf 8 is thus supported in a cantilever fashion without any visible supporting structure underneath, providing a clean uncluttered look. A light strip 60 may be attached to the top wall 44. With the shelf 8 made of glass, light from the light strip 60 is directed by the inclined surfaces 40 and 42 to the glass, where it is absorbed and makes the entire shelf 8 luminous.

The top wall 36 and the inclined surface 42 define a triangular body 61 attached to a vertical wall 62, which is attached to the top wall 44. The triangular body 61 is offset inwardly into the slot 4 with the vertical wall 62 substantially centered over the top wall 36, thereby distributing the load from the top rear portion of the shelf 8 to each side of the vertical wall 62. This arrangement advantageously provides a stable structure for supporting the torque imposed by shelf 8 on the top wall 36. The wall 62 is offset from the back walls 22 and 26 and the backboard 10.

Referring to FIGS. 4 and 5, the shelf 8 is inserted into the slot 8 by tilting the shelf 8 slightly upward to follow the incline of the bottom wall 34. The bottom edge 64 of the front wall 24 is spaced apart from the top surface of the shelf 8, as shown in FIG. 4, that makes the height of the opening 17 slightly larger than the thickness of the shelf 8 to allow convenient insertion of the shelf 8 while being slightly tilted upward. At the same time, the gap 37 provides space at the rear wall 32.

It is preferable to recess the thickness of the front walls 24 and 28 into the substrates 14 to make the front exterior surfaces of the substrates 14 flush with the adjacent front surfaces of the front walls 24 and 28, as shown in FIGS. 2-5, to allow the finish layer 16 to lie flat as it overlies the substrates 14 and the front walls 24 and 28.

Figure 6:
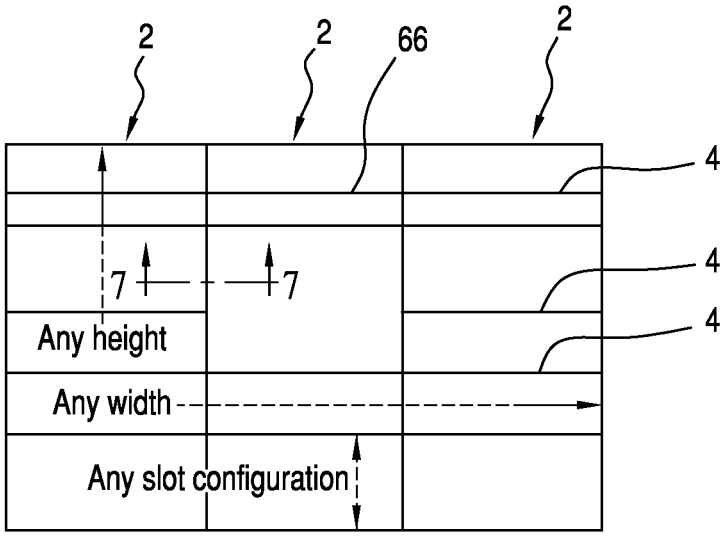
FIG. 6 is a schematic view of an assembly of individual slatwall panels embodying the present invention.
Figure 7:
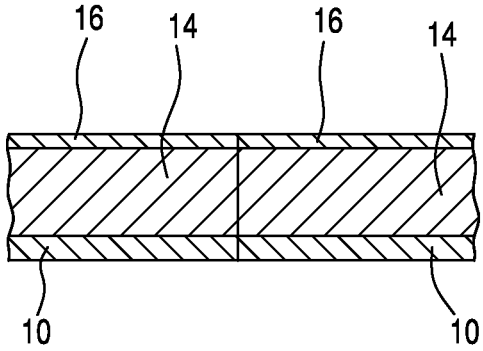
FIG. 7 is a cross-sectional view taken along line 7-7 in FIG. 6.

Referring to FIG. 6, the slatwall panel 2 may be combined with other slatwall panels 2 to provide the desired height and width. The panels are arranged on a side-to-side manner to form one continuous wall. The outer surface of each panel is flush with the outer surface of the adjacent panel to form one continuous flat surface, as shown in FIG. 7. Similarly, the slots 4 may be configured on each slatwall panel 4 separately of the other slots 4 in the other slatwall panels 4 as desired. The slot in one panel may or may not line up with a slot in the adjacent panel, as desired. For example, the slots from one panel may line up with the slots in the other panels to form one continuous slot that extends across several panels, such as that shown generally at 66, or they may be staggered from one panel to the next panel. Further, the slots in one panel may grouped into several groups where in each group the vertical spacing of the slots are the same, but different from the other groups, such as that shown in each panel in FIG. 6. A group may include one or more slots.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A slatwall channel for use in the assembly of a slatwall panel including a backboard, comprising:

a) a body including a longitudinal horizontal slot, and opposing longitudinal first and second grooves parallel to said slot;

b) said first groove including a first rear wall and a first front wall, said first groove including an opening disposed upwardly;

c) said second groove including a second rear wall and a second front wall, said second groove including an opening disposed downwardly;

d) said first rear wall and said second rear wall are configured to be attached to the backboard;

e) said slot including a rear wall, a bottom wall and a top wall forming a U-shaped groove;

f) said bottom wall is slanted downwardly toward said rear wall; and g) said U-shaped groove is configured to receive a shelf wherein said top wall provides a stop to a top rear portion of the shelf and a front portion of said bottom wall provides support to a bottom rear portion of the shelf.

2. A slatwall channel as in claim 1, wherein:

a) said slot includes a horizontal longitudinal branch groove communicating with said U-shaped groove; and b) said branch groove is disposed above said U-shaped groove.

3. A slatwall channel as in claim 2, wherein;

a) said branch groove is defined by first and second opposite inclined surfaces directed toward said slot; and b) first and second opposite vertical surfaces extending from respective said first and second opposite inclined surfaces.

4. A slatwall channel as in claim 3, wherein:

a) said branch groove includes a rear vertical wall;

b) said second vertical surface is disposed on said rear vertical wall;

c) said rear vertical wall is offset from said first and second rear walls; and d) said top wall is attached to said rear vertical wall.

5. A slatwall channel as in claim 1, wherein said second front wall joins said bottom wall at a corner.

6. A slatwall panel, comprising:

a) a backboard;

b) a slatwall channel attached to said backboard;

c) said slatwall channel including a longitudinal horizontal slot, and opposing longitudinal first and second grooves parallel to said slot;

d) said first groove including a first rear wall and a first front wall, said first groove including an opening disposed upwardly;

e) said second groove including a second rear wall and a second front wall, said second groove including an opening disposed downwardly;

f) said first rear wall and said second rear wall are attached to said backboard;

g) first and second substrates with corresponding edge portions disposed in said first and second grooves, respectively;

h) said slot including a rear wall, a bottom wall and a top wall forming a U-shaped groove;

i) said bottom wall is slanted downwardly toward said rear wall; and j) said U-shaped groove is configured to receive a shelf wherein said top wall provides a stop to a top rear portion of the shelf and a front portion of said bottom wall provides support to a bottom rear portion of the shelf.

7. A slatwall panel as in claim 6, wherein:

a) said slot includes a horizontal longitudinal branch groove communicating with said U-shaped groove; and b) said branch groove is disposed above said U-shaped groove.

8. A slatwall panel as in claim 7, wherein:

a) said branch groove includes a top wall; and b) a lighting strip attached to said top wall.

9. A slatwall panel as in claim 6, wherein:

a) said branch groove includes a slanted portion defined by first and second opposite inclined surfaces directed toward said slot; and b) first and second opposite vertical surfaces extending from respective said first and second opposite inclined surfaces.

10. A slatwall panel as in claim 6, wherein:

a) said second front wall joins said bottom wall at a corner; and b) said corner for engaging the bottom rear portion of the shelf.

11. A slatwall panel as in claim 6, and further comprising a finish layer disposed on an exterior surface of said first and second substrates.

12. A slatwall panel as in claim 11, wherein said finish layer overlaps said first and second front walls.

13. A slatwall panel as in claim 6, and further comprising a shelf received within said slot.

14. A slatwall panel as in claim 13, wherein said shelf is light transmitting.

* * * * *